US006867379B2

(12) United States Patent
Hayashi

(10) Patent No.: US 6,867,379 B2
(45) Date of Patent: Mar. 15, 2005

(54) ROTARY PUSH SWITCH DEVICE

(75) Inventor: Yukiharu Hayashi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/774,077

(22) Filed: Feb. 6, 2004

(65) Prior Publication Data

US 2004/0154910 A1 Aug. 12, 2004

(30) Foreign Application Priority Data

Feb. 7, 2003 (JP) ..... 2003-031298

(51) Int. Cl.[7] ..... H01H 9/00
(52) U.S. Cl. ..... 200/4
(58) Field of Search ..... 200/4, 5 R, 11 R, 200/14, 18, 329, 341, 346

(56) References Cited

U.S. PATENT DOCUMENTS 5,369,230 A * 11/1994 Misawa ..... 200/52 R
5,821,480 A * 10/1998 Machida ..... 200/4
6,067,424 A * 5/2000 Shono ..... 200/336
6,339,200 B1 * 1/2002 Shi et al. ..... 200/305
6,466,747 B2 * 10/2002 Tanaka ..... 200/329
6,525,277 B2 * 2/2003 Oba et al. ..... 200/4
6,610,937 B2 * 8/2003 Yamaguchi ..... 200/4
6,621,016 B2 * 9/2003 Ohba et al. ..... 200/4

FOREIGN PATENT DOCUMENTS

JP 2001-357758 12/2001

* cited by examiner

*Primary Examiner*—Lincoln Donovan
*Assistant Examiner*—M. Fishman
(74) *Attorney, Agent, or Firm*—Brinks Hofer Gilson & Lione

(57) ABSTRACT

A rotary push switch device includes a cylindrical rotary push knob, which is subjected to push and rotary operations, a rotary drive plate, which is rotated by the rotary push knob, a push knob, which is disposed inwardly of the rotary push knob and pushed, and a push rubber contact element which is pressed by pushing the push knob. When the push knob is subjected to the push operation, the rotary push knob is also pushed in association with the push knob, and when the rotary push knob is subjected to the rotary operation, the push knob is prevented from being rotated in association with the rotary push knob.

6 Claims, 4 Drawing Sheets

ROTARY PUSH SWITCH DEVICE

This application claims the benefit of priority to Japanese Patent Application No. 2003-031298, herein incorporated by reference.

BACKGROUND OF THE INVENTION

1. Field of the Invention

The present invention relates to a rotary push switch device that is preferably applied to an input to an air conditioner, a navigator, and the like, which are mounted on a vehicle, and is most suitable when a design is formed at a center.

2. Description of the Related Art

There are many switch devices that employ known technologies and can be subjected to rotary and push operations. For example, various types of electric parts such as rotary switches, push button switches, and the like, which are used in audio systems, air conditioners, and the like, are mounted on vehicles, and these electric parts are operated by drivers and passengers who manually manipulate operation knobs. Among these vehicle-mounted electric parts, there is known a rotary push switch device used in, for example, an audio system. The rotary push switch device has a rotary switch, which adjusts a sound volume of the audio system, and a push button switch, which is disposed in the rotary switch and turns on and off a power supply to the audio system as well as has a rotary knob for operating the rotary switch and a push knob for operating the push button switch, and these knobs are disposed coaxially with each other. Further, there is also known a rotary push switch device applied to a digital camera with a zoom function as disclosed in, for example, Japanese Unexamined Patent Application Publication No. 2001-357758 (refer to paragraph Nos. 0011 to 0029 and FIGS. 2 and 3 of the specification), which will be shown in FIGS. 4 and 5.

The rotary push switch device shown in FIGS. 4 and 5 is a device applied to a digital camera with a zoom function. The switch device is mainly composed of a support plate 1 made of a metal plate and the like, a flexible substrate 2, which is made of an insulating base member such as a polyester film and the like and has electric conductive patterns formed thereon, a first dome-shaped click spring 3 that also acts as a first movable contact element, a synthetic resin guide member 4 having a plurality of guide projections 4*a*, a synthetic resin drive member 5, which has a push projection 5*a* and can be caused to rise and fall by being guided by the guide projections 4*a*, a second dome-shaped click spring 6 that also acts as a second movable contact element, a metal slider element 7, a synthetic resin slider element receiver 8 to which the slider element 7 is attached, a synthetic resin accommodation member 9 having a ceiling portion 10 and a cylindrical portion 11, a self-return torsion spring 12, a synthetic resin key top 13, and a synthetic resin rotary operation member 14 arranged integrally with the slider element receiver 8.

The flexible substrate 2 is assembled in the rotary push switch device with its band-shaped portion 2*c* bent in an S-shape.

The first dome-shaped click spring 3, which also acts as the first movable contact element, is formed of a stainless steel sheet spring and formed in a dome shape. The click spring 3 is placed on the region of the flexible substrate 2, in which a first stationary contact element (not shown) is formed, comes into contact with an outer ring-shaped portion of the stationary contact element at all times as well as confronts an inner disc-shaped portion of the stationary contact element so as to come into contact with and depart from the portion. A first push switch element S1 is composed of the first click spring 3 and the first stationary contact element. When a somewhat large press operation force is applied to the click spring 3, the inverted central portion of the click spring 3 is caused to come into contact with the disc-shaped portion of the stationary contact element that confronts the central portion, so that the inner stationary contact element is electrically connected to the outer stationary contact element.

Since the second dome-shaped click spring 6, which also acts as the second movable contact element, is made of a stainless steel spring sheet and formed in a dome shape, the central portion of the click spring 6 can be inverted by a press operation force smaller than that of the first click spring 3. The second click spring 6 is placed on the region of a band-shaped portion 2*c* of the flexible substrate 2, in which a second stationary contact element (not shown) is formed, comes into contact with an outer ring-shaped portion of the stationary contact element at all times and confronts an inner disc-shaped portion of the stationary contact element so as to come into contact with and depart from the portion. A second push switch element S2 is composed of the second click spring 6 and the second stationary contact element. When a relatively small press operation force is applied to the click spring 6, the inverted central portion of the click spring 6 is caused to come into contact with the inner disc-shaped portion of the stationary contact element confronting it, so that the inner stationary contact element is electrically connected to the outer stationary contact element.

The guide member 4 has four elastically deformable columnar guide projections 4*a*, a frame-shaped portion 4*b* for coupling the base ends of the respective guide projections 4*a*, and three attachment projections 4*c* which extend from the frame-shaped portion 4*b* in a direction opposite to the guide projections 4*a*. Each guide projection 4*a* has a claw portion 4*d* projecting inward at the extreme end (free end) thereof. Further, the frame-shaped portion 4*b* has an engagement groove 4*e* that is formed thereto by projecting a part of the frame-shaped portion 4*b* outward in an L-shape.

The drive member 5 includes a push projection 5*a* for pushing the first click spring 3, a flat sheet portion 5*b* projecting the push projection 5*a* from the center thereof, engagement cutouts 5*c*, which are formed at four positions on the outer peripheral portion of the flat sheet portion 5*b* and into which the guide projections 4*a* are loosely inserted, respectively, an L-shaped hook 5*d* projecting sideward from flat sheet portion 5*b*, and a small projection 5*e* projecting from the flat sheet portion 5*b* sideward on a side opposite to the hook 5*d*.

The accommodation member 9 includes the ceiling portion 10, which has an opening 10*a* at the center thereof and arc-shaped slots 10*b* disposed at four positions, a cylindrical portion 11 suspending downward from the outer peripheral portion of the ceiling portion 10, and attachment projections 11*a* projecting at equal intervals from the bottom surface of the cylindrical portion 11 at six positions. Further, a ring-shaped wall 10*d*, which regulates the position of the self return torsion spring 12 from an inside, and a spring receiving portion 10*f*, which causes a taper surface 10*e* to collide against an end of the torsion spring 12 and to stop thereat, stand on the ceiling portion 10, and the torsion spring 12 is assembled between the ring-shaped wall 10*d* and the spring receiving portion 10*f*.

The drive member 5, on which the second push switch element S2 is placed, and the guide projections 4*a* of the guide member 4 are disposed in the opening 10*a* of the accommodation member 9. Further, the slider element receiver 8 is disposed inwardly of the cylindrical portion 11 of the accommodation member 9 in confrontation with the ceiling portion 10, and the outer peripheral surface of the slider element receiver 8 is in sliding contact with the inner peripheral surface of the cylindrical portion 11. Then, the rotary operation member 14 is integrated with the slider element receiver 8 by inserting four coupling projections 14*b* of the rotary operation member 14, which is disposed on the ceiling portion 10 of the accommodation member 9, into the slots 10*b*, respectively and further into coupling holes 8*b* of the slider element receiver 8, and thermally caulking the extreme ends of the respective coupling projections 14*b* to the bottom surface of the slider element receiver 8. Accordingly, the rotational motion of the rotary operation member 14 is guided by the inner peripheral surface of the cylindrical portion 11 that functions as a bearing surface with respect to the outer peripheral surface of the slider element receiver 8.

The rotary operation member 14 has an opening 14*a*, in which the key top 13 is disposed, at the center thereof. The coupling projections 14*b* project from the bottom surface of the rotary operation member 14 at four positions at equal intervals, and the rotary operation member 14 is integrated with the slider element receiver 8 through the coupling projections 14*b*. Note that a push projection 13*a*, which projects from the center of the inner bottom surface of the key top 13, is mounted on the second click spring 6 in a state that the rotation of the key top 13 is prevented by the rotary operation member 14, and the rising and falling motion of the key top 13 is guided by the inner wall portion of the rotary actuating member 14.

An operation of the rotary push switch device arranged as described above will be explained. First, an operation of a push switch portion, which is pressed through the key top 13, will be explained. Next, an operation of a rotary type electric part portion, which is rotated through the rotary operation member 14, will be explained.

When an operator pushes the key top 13 with a finger in a predetermined amount, the push projection 13*a* of the key top 13 inverts the second click spring 6 having a small operation force, thereby the second push switch element S2 is switched from an on-state to an off-state. When the operator further pushes the key top 13, the drive member 5 is caused to fall while the on-state of the second push switch element S2 is kept, thereby the push projection 5*a* of the drive member 5 inverts the first click spring 3 having a large operation force, so that the first push switch element S1 is switched from an off-state to an on-state. Accordingly, when a click feel is imparted at the time the operator lightly pushes the key top 13, the operator can feel that the second push switch element S2 has been turned on, and when a click feel is imparted at the time the operator strongly pushes the key top 13, the operator can feel that the first push switch element S1 has been turned on. Specifically, in the embodiment, when the second push switch element S2 is turned on, a digital camera is focused, and when the first push switch element S1 is turned on, a shutter is actuated.

Further, when the rotary operation member 14 is rotated by the operator, the slider 7 is rotated together with it and slides on the sliding patterns (a resistor pattern and a collector pattern) formed on the flexible substrate 2, thereby a resistance value is output according to a position of the rotatingly moved slider 7. That is, a different resistance value can be output according to an amount of rotation of the rotary operation member 14, and in this embodiment, zooming of the digital camera can be executed by rotating the rotary operation member 14.

Incidentally, in a known rotary push switch device, a center knob on which a center logo is formed, is arranged so as not to be rotated. Accordingly, since a knob (key top 13) located at a center has only a push function and a rotary function is provided with only an outside knob (rotary operation member 14), when a push operation is executed continuously from a rotary operation, it is difficult to execute the push operation by means of the outside knob, and thus the known rotary push switch device is disadvantageous in operability.

Accordingly, an object of the present invention, which was made in view of the above circumstances of the related art, is to provide a rotary push switch device arranged such that when a push operation is executed through a push knob, the push operation is executed by a rotary push knob in association with the push operation of the push knob.

SUMMARY OF THE INVENTION

A rotary push switch device in one embodiment of the present invention includes a cylindrical rotary push knob that is subjected to push and rotary operations, a rotary type electric part unit rotated by the rotary push knob, a push knob that is subjected to a push operation, and a push switch unit pressed by pushing the push knob, wherein when the rotary push knob is subjected to the push operation, the push knob is pushed in association with the rotary push knob, and when the rotary push knob is subjected to the rotary operation, the push knob is prevented from being rotated in association with the rotary push knob.

With the above arrangement, when the rotary operation is executed, the push knob, on which a center logo is formed, is not rotated and only the rotary push knob disposed outwardly of the push knob is rotated, and when the push operation is executed, the push knob and the rotary push knob can be pushed together at the same time.

In the above arrangement, it is preferable that the push knob be disposed inwardly of the rotary push knob.

Further, in the above arrangement, it is preferable that the rotary type electric part unit includes a rotary cam that is coupled with the rotary push knob and operated together with it, the rotary push knob include a projection, the push knob be clamped between the projection and the rotary cam, when the rotary push knob or the push knob is subjected to the push operation, the rotary push knob and the push knob be operated at the same time, and when the rotary push knob is subjected to the rotary operation, the rotary push knob be free to move with respect to the push knob.

In the above arrangement, it is preferable that the projection of the rotary push knob be formed in a ring shape.

Further, in the above arrangement, it is preferable that the push switching unit include a holder that holds a substrate on which a stationary contact element is disposed and that the push knob be fixed to the holder through a hook.

Further, in the above arrangement, it is preferable that the substrate include a light source that illuminates the push knob.

DESCRIPTION OF THE PREFERRED EMBODIMENTS

Figure 1:
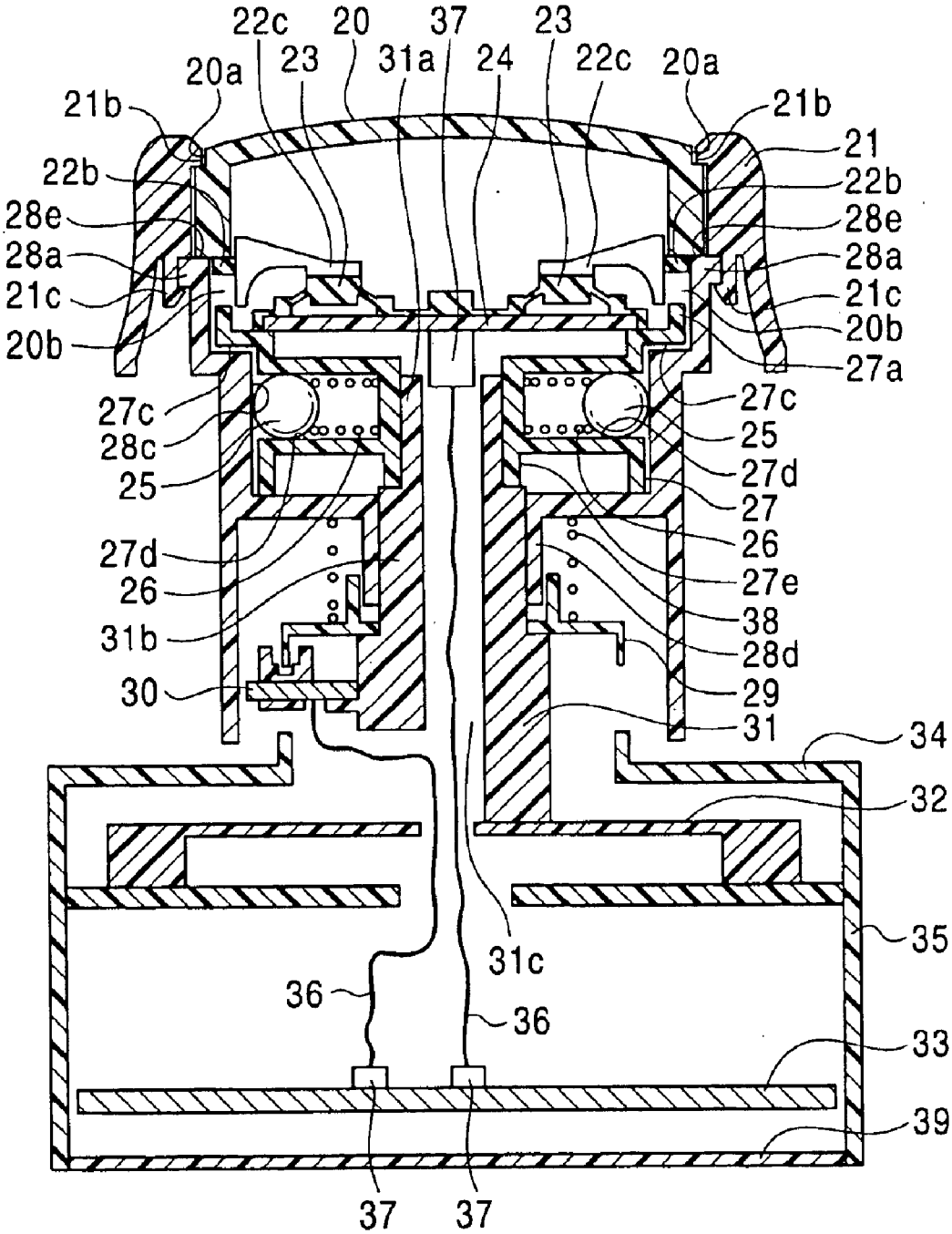
FIG. 1 is a longitudinal sectional view of a rotary push switch device according to an embodiment of the present invention.
Figure 2:
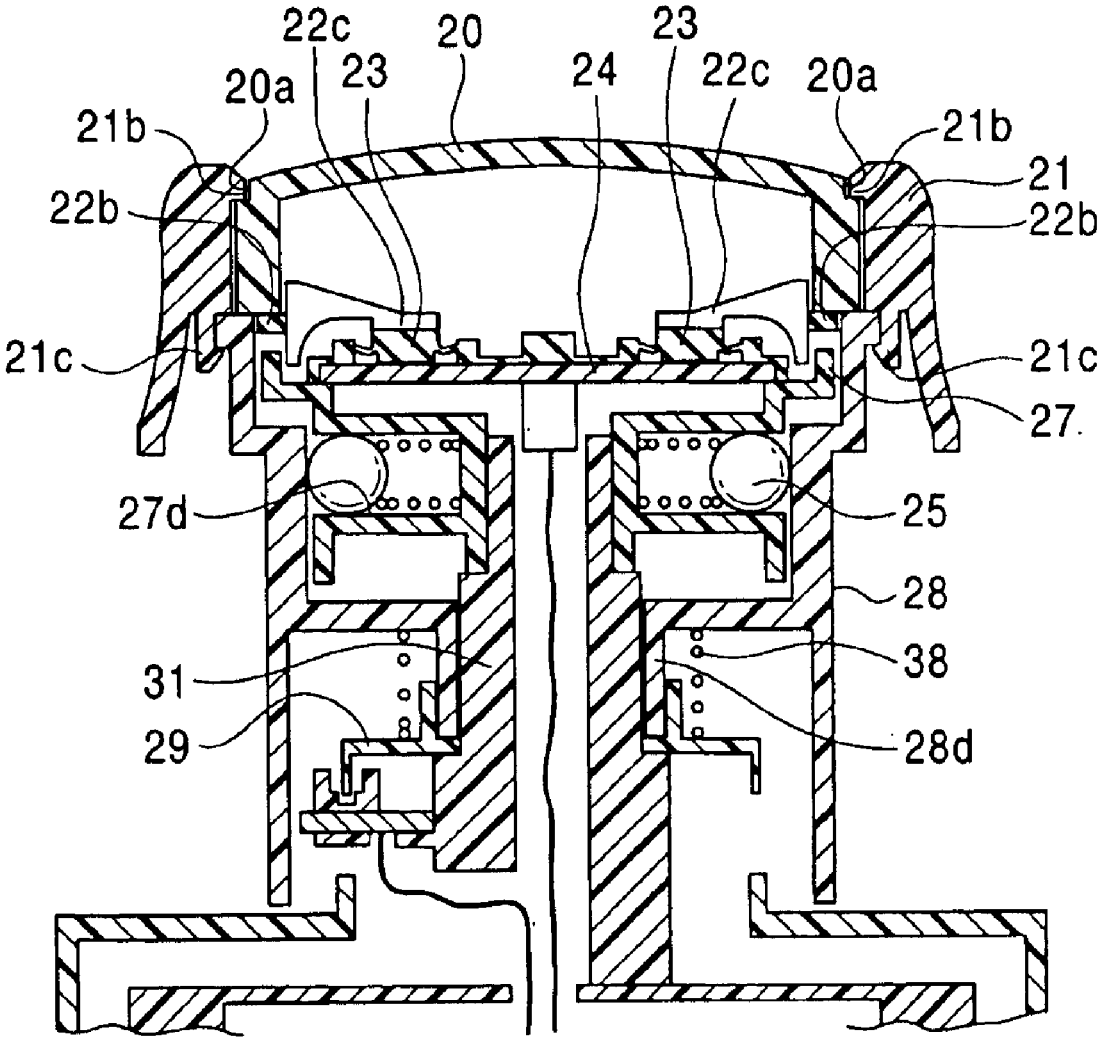
FIG. 2 is a longitudinal sectional view of the rotary push switch device shown in FIG. 1 when it is subjected to a push operation.
Figure 3:
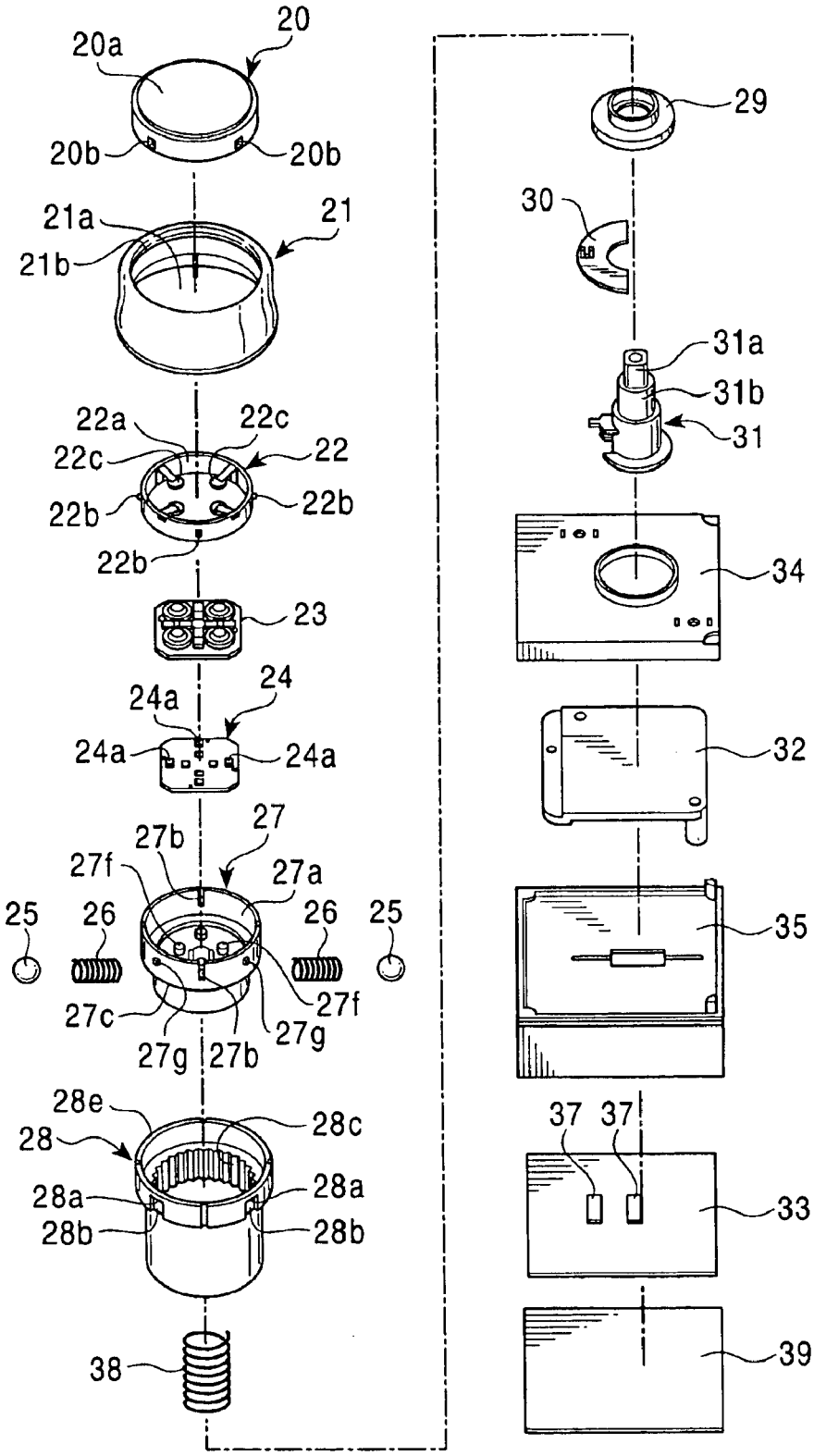
FIG. 3 is an exploded perspective view of the rotary push switch device shown in FIG. 1.
Figure 4:
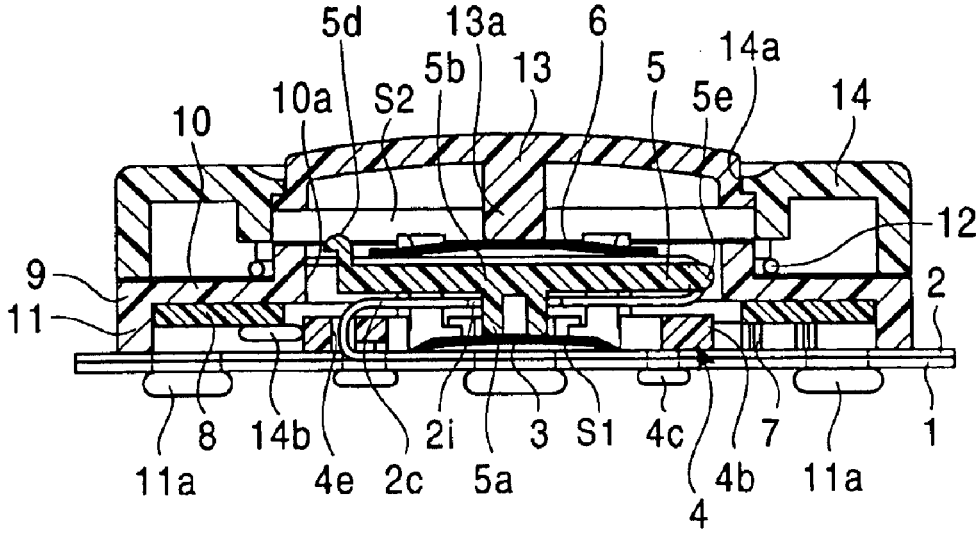
FIG. 4 PRIOR ART
FIG. 4 is a longitudinal sectional view of a known rotary push switch device.
Figure 5:
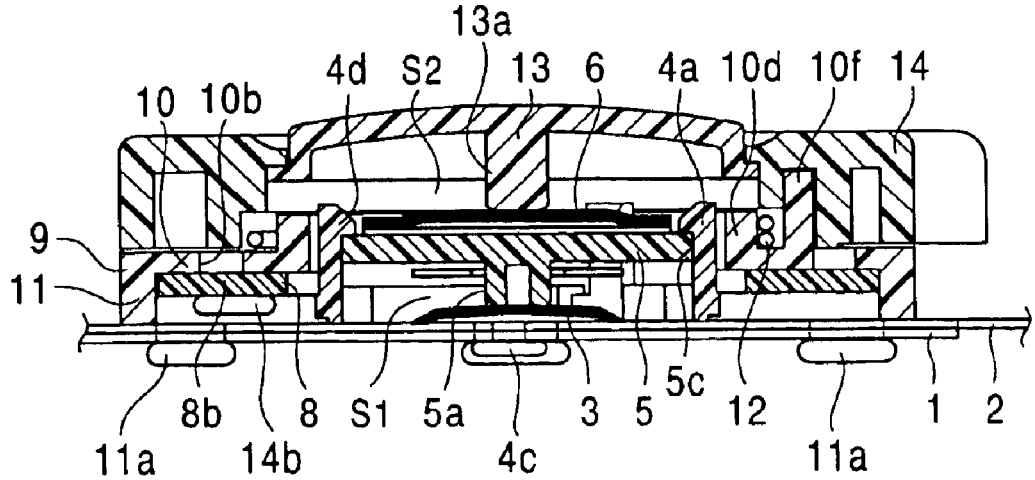
FIG. 5 PRIOR ART
FIG. 5 is a sectional view of the known rotary push switch device taken along a diagonal line when it is viewed on plane.

An embodiment of the present invention will be explained with reference to the drawings. FIG. 1 is a longitudinal sectional view of a rotary push switch device according to the embodiment of the present invention, FIG. 2 is a longitudinal sectional view of the rotary push switch device shown in FIG. 1 when it is subjected to a push operation, and FIG. 3 is an exploded perspective view of the rotary push switch device shown in FIG. 1.

As shown in the drawings, the rotary push switch device according to the embodiment is composed of a push knob 20, a rotary push knob 21, a push ring 22, a push rubber contact element 23 that is pushed by the push ring 22, a push substrate 24, which is paired with the push rubber contact element 23 and constitutes a push switch, a hard ball holder 27 for holding hard balls 25 and springs 26, which impart a click feel when a rotary operation is executed, a rotary cam 28, a rotary drive plate 29 for detecting the rotary operation, a sensor substrate 30, which is paired with the rotary drive plate 29 and detects the rotary operation, a shaft 31, a support plate 32, a main substrate 33, and upper and lower cases 34 and 35 that support the support plate 32 and the main substrate 33. The rotary push knob 21 has an opening 21*a* in which the push knob 20 is disposed and executes also a push operation, the push ring 22 is pushed by the push knob 20 and transmits the push operation to a contact element, the rotary cam 28 is operated in association with the rotary push knob 21 and has a cam 28*c* for imparting a click feel by being paired with the hard balls 25, the shaft 31 holds the hard ball holder 27, the drive plate 29, and the sensor substrate 30, the support plate 32 supports all the hard ball holder 27, the rotary drive plate 29, the sensor substrate 30, and the shaft 31, and the main substrate 33 brings together the signals output by the rotary operation and the push operation.

The push knob 20 is made of synthetic resin and formed in a cylindrical shape having an open lower surface and a closed upper surface. The push knob 20 is disposed in an opening 21*a* of the rotary push knob 21. The push knob 20 has a ring-shaped engaging portion 20*a* formed in a recessed groove shape at the upper end of the outer peripheral surface thereof, and the rotary push knob 21 is engaged with the ring-shaped engaging portion 20*a*. Further, the push knob 20 has engaging portions 20*b* formed at four positions and integrated with the hard ball holder 27 by being hook coupled with projections 27*g* disposed to the hard ball holder 27 through the engaging portions 20*b*.

The push ring 22 is subjected to a push operation executed by the push knob 20 and transmits it to the push rubber contact element 23. As shown in FIG. 3, the push ring 22 is composed of a ring portion 22*a*, four projections 22*b* projecting from the outer peripheral surface of the ring portion 22*a*, and four contact element push pieces 22*c* extending from the inner peripheral surface of the ring portion 22*a* toward a center.

The push rubber contact element 23 is formed of four push rubber contact sub-elements 23, which are molded together, and attached to the push substrate 24, which is paired with the push rubber contact element 23 and constitutes a push switch, so as to cover the push substrate 24.

The push substrate 24 includes an illumination LED 24*a* that can illuminate the push knob 20. The push substrate 24 is formed in a square shape and has fixed contact portions formed thereto (not shown) so as to be connected to the respective push rubber contact sub-elements 23. Further, although not shown, the push substrate 24 has positioning/fixing holes drilled therethrough, and the push substrate 24 is fixed on the upper surface of the hard ball holder 27 by fitting positioning/fixing projections projecting from the hard ball holder 27 into the holes.

As shown in FIG. 3, the hard ball holder 27 is formed in a cylindrical shape with the upper and lower surfaces thereof opened and has an upper cylinder portion 27*a* to which cutout portions 27*b* are formed from the upper edge thereof at four positions, and the projections 22*b* of the push ring 22 are inserted into the cutout portions 27*b*. With the above arrangement, although the push ring 22 can move along the cutout portions 27*b* of the hard ball holder 27, it is restricted to move in the peripheral direction of the ring portion 22*a* thereof. The inside of the upper cylindrical portion 27*a* is arranged as an accommodating portion for accommodating the push rubber contact element 23 and the push substrate 24. The outer peripheral diameter of the lower portion of the hard ball holder 27 is set smaller than that of the upper portion thereof, and a stepped portion 27*c* is formed around the boundary between the lower portion and the upper portion as well as two accommodation holes 27*d*, which accommodate and hold the hard balls 25 and the springs 26, are formed at diametrically opposite positions of the hard ball holder 27, and the respective hard balls 25 are urged outward by the springs 26, respectively. Further, a bearing portion 27*e* is drilled through the lower portion of the hard ball holder 27 and communicates with the upper portion thereof, and the hard ball holder 27 is fixed by fitting the bearing portion 27*e* on the shaft 31. The rotation of the push knob 20, which is integrated with the hard ball holder 27 by the above arrangement, is prevented. Further, four positioning/fixing projections 27*f* project from the bottom surface of the accommodating portion in the upper cylindrical portion 27*a*. Projections 27*g* are formed on the upper cylindrical portion 27*a* at four positions, and the engaging portions 20*b* of the push knob 20 are hook coupled with the respective projections 27*g*.

The rotary push knob 21 is molded of synthetic resin and formed in a hollow shape having the cylindrical opening 21*a*. A ring-shaped projection 21*b* is formed around the upper edge of the opening 21*a* of the rotary push knob 21, and a snap claw 21*c* is formed downward from the lower end of the opening 21*a*. The ring-shaped projection 21*b* is engaged with the ring-shaped engaging portion 20*a* of the push knob 20, whereas the snap claw 21*c* is engaged with the lower surface an engaging portion 28*a* formed on the outside surface of the rotary cam 28 at the upper end thereof. With the above arrangement, the rotary push knob 21 is integrated with the rotary cam 28 by snap locking the snap claw 21*c* to the engaging portion 28*a*. In contrast, although the push knob 20 is integrated with the rotary push knob 21 in a push direction on the outer peripheral surface thereof by the support portion 28*e* of the rotary cam 28 and the ring-shaped projection 21*b* of the rotary push knob 21, the rotary push knob 21 is clamped so as to be free to move in a rotary direction with respect to the push knob 20. Accordingly, the rotary push knob 21 is moved together with the push knob 20 in the push direction of the push knob 20, and when the rotary push knob 21 is rotated, it is rotated together with the rotary cam 28. However, the push knob 20 is not rotated because the rotation thereof is prevented by the hook coupling of it with the projections 27*g* of the hard ball holder 27.

The rotary cam 28 is formed in a cylindrical shape in its entirety, and the engaging portion 28*a*, which is engaged with the snap claw 21*c*, is formed on the outer peripheral surface of the upper cylindrical portion at the upper end thereof, and recessed portions 28*b* are formed to the engaging portion 28*a* from the lower end of the outer peripheral surface thereof at four positions. Therefore, the rotary cam 28 is operated in association with the rotary push knob 21 by the snap claw 21*c*. The cam 28*c* is disposed on the inner peripheral surface of the upper cylindrical portion and imparts the click feel by being paired with the hard balls 25. Further, a bearing portion 28*d* is disposed in the lower cylindrical portion of the rotary cam 28 and fitted on the shaft 31, thereby the bearing portion 28*d* can be moved in the axial direction and the peripheral direction of the shaft 31. Further, the support portion 28*e* is formed to the rotary cam 28 to integrate the push knob 20 with the rotary push knob 21 in the push direction together with the ring-shaped projection 21*b* of the rotary push knob 21.

The bearing portion 27*e* of the hard ball holder 27 is fitted on and fixed to a small diameter portion 31*a* of the shaft 31, the bearing portion 28*d* of the rotary cam 28 is loosely fitted on a medium diameter portion 31*b* of the shaft 31 so as to be free to move in the axial direction and the peripheral direction, and further the drive plate 29 and the sensor substrate 30 are held by the shaft 31. Further, a hollow portion 31*c* is formed to the shaft 31, and connection lines 36 are wired in the hollow portion 31*c* and connected to respective connectors 37. An urging coil spring 38 is compressed and interposed between the drive plate 29 and the rotary cam 28. The shaft 31 is fixed to the support plate 32 at the lower end thereof, and the support plate 32 is attached and fixed to the lower case 35.

A signal from the push substrate 24 is transmitted to the main substrate 33 by passing the connection lines 36 through the shaft 31. A signal from the sensor substrate 30 is also transmitted to the main substrate 33 through the inside of the shaft 31. Further, a signal is supplied to the illumination LED 24*a* through the inside of the shaft 31 likewise the push switch.

The urging coil spring 38 is interposed between the rotary drive plate 29 and the rotary cam 28, the rotary cam 28 is urged upward by the urging coil spring 38 and pushed against the hard ball holder 27 fixed to the shaft 31.

A cover 39 is attached to the lower surface of the lower case 35.

An operation of the rotary push switch device arranged as described above will be explained.

FIG. 1 shows a non-operating state of the rotary push switch device. To explain the arrangement of the respective components that are operated in association with each other, the shaft 31 and the hard ball holder 27 are fixedly disposed, and the components such as the push substrate 24 and the like that are fixed thereto are also fixedly disposed. The rotary push knob 21 is integrated with the rotary cam 28 by the snap claw 21*c*, and the bearing portion 28*d* is rotatably supported by the shaft 31. Further, the bearing portion 28*d* is supported by the shaft 31 so as to be moved in the axial direction (up/down direction in the figure by the push operation) of the shaft 31, and when the rotary push knob 21 and the rotary cam 28 are pushed downward in the figure, the push knob 20 is engaged with the ring-shaped projection 21*b* of the rotary push knob 21 and also pushed downward together with the rotary push knob 21.

When the operator holds and rotates the rotary push knob 21 in the state shown in FIG. 1, the rotary cam 28 is rotated together with the rotary push knob 21. When the rotary cam 28 is rotated, the click feel is imparted by the hard balls 25 that are pressed against the cam 28*c* by the springs 26 as well as moderated by the recesses of the cam 28*c*. The rotary drive plate 29 is rotated by the rotation of the rotary cam 28, so that the rotary operation is detected by the sensor substrate 30, thereby pulse signals are output according to a rotating direction and an amount of rotation. Desired equipment can be adjusted based on the output signals. As described above, when the rotary push knob 21 is subjected to the rotary operation, the push knob 20 is not rotated because the rotation thereof is prevented as described above.

Further, when the operator pushes the push knob 20 or the rotary push knob 21 with a finger, they are moved together downward in the figure. At this time, the rotary cam 28 is also lowered against the urging coil spring 38. Further, when the push knob 20 is lowered, the push ring 22 is lowered through the projections 22*b* and the push rubber contact sub-elements 23 are pushed by the contact element push pieces 22*c*, thereby a switch signal is output from the push switch. A power supply of desired equipment can be turned on or off in response to the output signal. FIG. 2 shows a state after the push operation has been executed. Note that a reason why four push sub-switches, which are composed of the push rubber contact sub-elements 23, are pushed by the four contact element push pieces 22*c*, is to prevent a push operation from being uncertainly executed when the peripheral edge of the push knob 20 is pushed, and the like. In contrast, when the push operation is stopped, the rotary cam 28 is moved upward in the figure by the force accumulated by the urging coil spring 38, and thus the rotary push knob 21 and the push knob 20 are also moved upward and return to the state shown in FIG. 1.

With the above arrangement, the rotary push switch device includes the cylindrical rotary push knob 21, which is subjected to the push and rotary operations, the rotary drive plate 29, which is rotated by the rotary push knob 21, the push knob 20, which is disposed in the rotary push knob 21 and subjected to the push operation, and the push rubber contact element 23 which is pressed by pushing the push knob 20, when the rotary push knob 21 is subjected to the push operation, the push knob 20 is also pushed in association with the rotary push knob 21, and when the rotary push knob 21 is subjected to the rotary operation, the push knob 20 is prevented from being rotated in association with the rotary push knob 21. Accordingly, when the rotary push knob 21 is subjected to the rotary operation, a design (logo and the like) formed on the push knob 20 is prevented from being rotated and thus prevented from being inverted because the push knob 20 is not rotated in association with the rotary push knob 21, thereby the commodity value of the rotary push switch device can be improved. Further, since the rotary push knob 21 can be also subjected to the push operation, the operability of the push operation can be improved because the push operation is not interfered with by the rotary push knob 21.

The present invention is executed by the embodiment described above and achieves the following effects.

When the rotary push knob is subjected to the rotary operation, the design (logo and the like) formed on, for example, the push knob is not rotated and thus is not inverted because the push knob is prevented from being rotated in association with the rotary push knob, thereby the commodity value of the rotary push switch device can be improved. Further, since the rotary push knob can be also subjected to the push operation, the operability of the push operation can be improved because the push operation is not interfered with by the rotary push knob.

What is claimed is:

1. A rotary push switch device, comprising: a cylindrical rotary push knob that is subjected to push and rotary operations, a rotary type electric part unit rotated by the rotary push knob, a push knob that is subjected to a push operation; and a push switching unit pressed by pushing the push knob, wherein when the rotary push knob is subjected to the push operation, the push knob is pushed in association with the rotary push knob, and when the rotary push knob is subjected to the rotary operation, the push knob is prevented from being rotated in association with the rotary push knob.

2. A rotary push switch device according to claim 1, wherein in that the push knob is disposed inwardly of the rotary push knob.

3. A rotary push switch device according to claim 1, wherein the rotary type electric part unit comprises a rotary cam that is coupled with the rotary push knob and operated together with the rotary push knob, the rotary push knob comprises a projection, the push knob is clamped between the projection and the rotary cam, when the rotary push knob or the push knob is subjected to the push operation, the rotary push knob and the push knob are pushed at the same time, and when the rotary push knob is subjected to the rotary operation, the rotary push knob is free to move with respect to the push knob.

4. A rotary push switch device according to claim 3, wherein the projection of the rotary push knob is formed in a ring shape.

5. A rotary push switch device according to claim 1, wherein the push switching unit comprises a holder that holds a substrate on which a stationary contact element is disposed, and the push knob is fixed to the holder through a hook.

6. A rotary push switch device according to claim 5, wherein the substrate comprises a light source that illuminates the push knob.

* * * * *